US010212525B2

(12) United States Patent
Hagen et al.

(10) Patent No.: US 10,212,525 B2
(45) Date of Patent: Feb. 19, 2019

(54) UNIVERSAL EARPIECE

(71) Applicant: Blue-Gear, Inc., Plymouth, MN (US)

(72) Inventors: Lawrence T Hagen, Deephaven, MN (US); Johan D Carlson, Edina, MN (US); Randall Wayne Roberts, Eden Prairie, MN (US); Margaret V Nilson, Annandale, MN (US)

(73) Assignee: Blue-Gear, Inc., Plymouth, MN (US)

( * ) Notice: Subject to any disclaimer, the term of this patent is extended or adjusted under 35 U.S.C. 154(b) by 0 days.

(21) Appl. No.: 15/179,097

(22) Filed: Jun. 10, 2016

(65) Prior Publication Data

US 2017/0127198 A1 May 4, 2017

Related U.S. Application Data

(63) Continuation of application No. 14/110,064, filed as application No. PCT/US2012/032211 on Apr. 4, 2012, now Pat. No. 9,398,362.

(60) Provisional application No. 61/616,940, filed on Mar. 28, 2012, provisional application No. 61/516,565, filed on Apr. 5, 2011.

(51) Int. Cl.
*H04R 25/00* (2006.01)
*H04R 1/10* (2006.01)

(52) U.S. Cl.
CPC ..... *H04R 25/656* (2013.01); *H04R 1/105* (2013.01); *H04R 1/1008* (2013.01); *H04R 25/40* (2013.01); *H04R 25/554* (2013.01); *H04R 25/60* (2013.01); *H04R 25/602* (2013.01); *H04R 25/604* (2013.01); *H04R 1/1016* (2013.01); *H04R 25/65* (2013.01); *H04R 25/652* (2013.01); *H04R 25/654* (2013.01); *H04R 2225/025* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,878,560 | A | 11/1989 | Scott | |
| 5,002,151 | A | 3/1991 | Oliveira et al. | |
| 5,712,453 | A | 1/1998 | Bungardt et al. | |
| 6,097,825 | A | 8/2000 | Yoest et al. | |
| 6,205,227 | B1 | 3/2001 | Mahoney et al. | |
| 6,319,020 | B1 | 11/2001 | Brimhall et al. | |
| 6,359,992 | B1 | 3/2002 | Preves et al. | |
| 6,389,142 | B1 | 5/2002 | Hagen et al. | |
| 6,434,248 | B1 | 8/2002 | Juneau et al. | |
| 7,394,910 | B2 | 7/2008 | Smith et al. | |
| 7,708,110 | B2 | 5/2010 | Leong et al. | |
| 8,374,367 | B2 * | 2/2013 | Nielsen | H04R 25/658 381/313 |
| 2007/0183613 | A1 | 8/2007 | Juneau | |
| 2008/0095392 | A1 | 4/2008 | Balke et al. | |
| 2009/0116731 | A1 | 5/2009 | Melkisetoglu et al. | |
| 2009/0262964 | A1 | 10/2009 | Havenith et al. | |
| 2009/0316940 | A1 | 12/2009 | Pander et al. | |
| 2010/0103170 | A1 | 4/2010 | Baloch et al. | |
| 2010/0226517 | A1 | 9/2010 | Lamba | |

(Continued)

*Primary Examiner* — Amir Etesam
(74) *Attorney, Agent, or Firm* — Dicke, Billig & Czaja, PLLC

(57) ABSTRACT

An earpiece designed to fit a substantial majority (over 90%) of people without customization to the outer ears, i.e., without the need to make customized measurements or a mold of the actual ear of an individual.

16 Claims, 15 Drawing Sheets

(56) References Cited

U.S. PATENT DOCUMENTS

| | | | |
|---|---|---|---|
| 2011/0166680 | A1 | 7/2011 | Pander |
| 2011/0299709 | A1 | 12/2011 | Anderson et al. |
| 2011/0316727 | A1 | 12/2011 | Bioemen |

* cited by examiner

UNIVERSAL EARPIECE

CROSS-REFERENCE

This application claims the benefit of: U.S. Provisional Application No. 61/516,565 filed Apr. 5, 2011; U.S. Provisional Application No. 61/616,940 filed Mar. 28, 2012; International Patent Application Number PCT/US12/32241 filed Apr. 2, 2012; and U.S. patent application Ser. No. 14/110,064 filed Oct. 4, 2013, now U.S. Pat. No. 9,398,362 issued Jul. 19, 2016.

TECHNICAL FIELD

This application pertains to an ear insert designed to fit a substantial majority of people without customization to the outer ears of individuals, i.e., without custom molds of the outer ear being required.

BACKGROUND

In this application, the term earpiece—including the term "ear mold" (sometimes expressed as the closed compound word "earmold")—refers to any device placed into the outer ear for purposes of affecting hearing—whether by enhancement (e.g., a hearing aid, an earphone, audio headphones) or by reduction (e.g., protection against loud sounds such as would be experienced in the vicinity of guns, aircraft engines, concerts, etc.). Such purposes include effects on hearing which are not performed by the earpiece per se; for example, a stethoscope (acoustical or electronic) which employs earpieces as described below for its eartips is within the scope of this application. Other applications include cell phone communication (e.g., Bluetooth™ or other wireless protocols, or wired connection); wired or wireless computer, radio, TV, iPod®, iPad®, and other similar types of audio listening (including consumer, professional, and "audiophile" applications); and in general any application in which there is a need for better fitting appliances for the outer ear for reasons of comfort, lasting fit, or both.

The hearing health care field and consumer electronic industry have long pursued without success a viable, single-physical-size earpiece. Numerous standard fitting earpieces have been advocated to house hearing devices or communication devices or to be used with them, respectively. To date, few of these have proven to provide a satisfactory universal fit. There are always some ears on which these devices do not fit properly, resulting in ear irritation and/or acoustic feedback produced by the lack of an adequate acoustic seal of the ear canal, occlusion problems or poor retention in the ear. For example, poorly-fitting earpieces are one of the main causes for a large percentage of hearing aids being returned or not being used.

Some of these poor-fit problems are caused by the unforgiving, hard, incompressible acrylic material used to house the electronic components. The difficulty applies to either custom or standard earpieces and occurs when the wearer speaks or chews, exercises, or moves, any of which causes the ear canal to change shape significantly, thus causing an earpiece to no longer fit well. The result at these times of jaw movement is a poorly-fitting earpiece that causes the earpiece to fall out or allow slit leakage to occur, which produces acoustic feedback and is uncomfortable to wear because it irritates the wearer's outer ear.

Numerous attempts have been made to solve the jaw moving-poorly fitting earmold/earpiece problem. For example, U.S. Pat. No. 6,434,248 B1 describes a custom in-the-ear type hearing aid made with a soft shell that conforms to the wearer's ear canal as jaw motion occurred. The soft shell encapsulates the electronic components of the hearing aid and is bonded to a hard faceplate. While this approach provides a theoretical improvement over a hard-shell hearing device, difficulties were encountered in trying to reliably adhere the shell to the faceplate, and, in practice, the two parts often separated. In addition, the soft shell materials tend to tear apart and the wires often break.

Universally-fitting or standard size earpieces were developed in the hearing industry for a number of reasons: product cost and time for device delivery were reduced because there was no longer a two to three week wait between the time at which the ear impression was taken and delivery of a custom hearing aid. A proper universal fitting hearing device requires less follow-up care for the wearer, translating into less time in the hearing professional's office trying to solve fit problems, resulting in greater satisfaction with hearing devices.

There have been numerous attempts at developing and manufacturing standard fitting earpieces. For example, U.S. Pat. No. 6,205,227 describes a standard fit hearing device with a rigid shell and hollow, deformable tip. The problem with this device was that the rigid shell was too large for some ears, and the flexible tip was either too large or too small for some ears, both problems resulting in an unacceptably low successful fitting rate. U.S. Pat. No. 6,097,825 describes a hearing aid packaged in standardized spheroidal housings having predetermined curvatures corresponding to that of typical ear canals. The problem with this approach was that there were many ear canals whose curvature did not correspond with those of the spheroidal housings. In another example, U.S. Pat. No. 5,002,151 describes a soft, disposable sleeve in several standard lengths that has threads which screw onto mating threads on an earpiece. The problem with this assembly was that a combination of the foam tip and earpiece was too long for most ear canals, resulting in the earpiece sticking out of the wearer's ear.

SUMMARY OF THE DISCLOSURE

In one aspect, this application discloses a standard fit, limited-contact earpiece designed to house any of a variety of hearing device components. In another aspect, this application discloses an earpiece to hold a hearing device in place on a wearer's ear. In either case, the hearing device may be a complete hearing aid, communication device, medical device, audio headphones/monitors, or an assistive listening device. In conjunction with any of these devices, if they are worn on the head, an earpiece is used to hold them in place on the wearer's ear. In another aspect, the earpiece may be a passive device for hearing protection, such as when equipped with an occluding tip. In yet another aspect, the earpiece may be a replacement for a hearing aid earmold. Thus, one aspect of an earmold for any of the above purposes, is a one-size-fits-all crescent-shaped earpiece (or C-shell), in which four major points of the outer ear are in contact with the earpiece, the concha bowl, tragus, antitragus and helix. This product can be used as an open ear device which prevents osculation for the end user.

DETAILED DESCRIPTION

Throughout the following discussion it should be understood that embodiments of the invention may be illustrated with respect to a device suitable for use with the left ear, or with the right ear, without any loss of generality. In the most preferred commercial applications of any embodiment disclosed here, there will be a pair of devices, one for each of the left and right ears, and they will be mirror images of each other with respect to shape, size, and other "fit-related" physical structure. They may, if necessary, be slightly different from each other despite one or (preferably) both being fully within the scope of the invention. Also, depending on the circumstances, functional components which are not "fit-related," such as electronic components, may also be identical (differing only by the nature of the signals carried or processed by the electronic components), or again if necessary the functional components may be slightly different from each other as desired.

As illustrated in FIGS. 1-7, earpiece 1 comprises base 2, helix extension 3, and ear canal extension 4. The embodiment illustrated in FIGS. 1-7 is suitable for use in the left ear, and thus is the mirror image of an embodiment suitable for use in the right ear.

Figure 1:
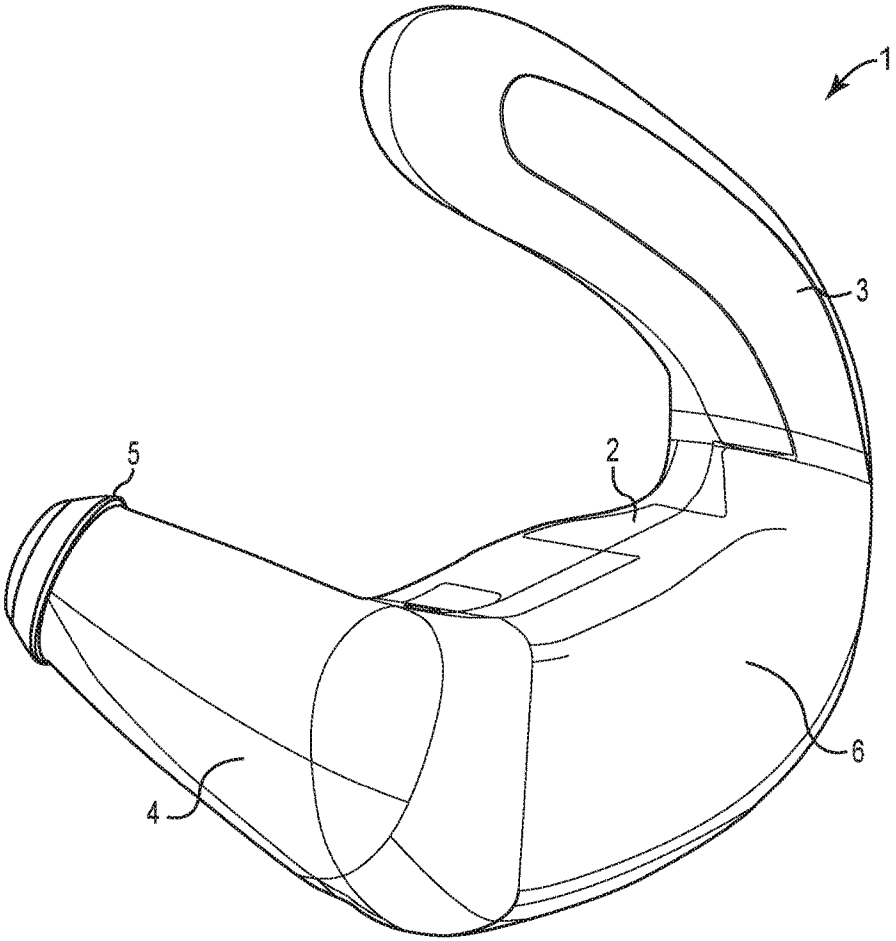
FIG. 1 is a perspective view of a first embodiment.
Figure 3:
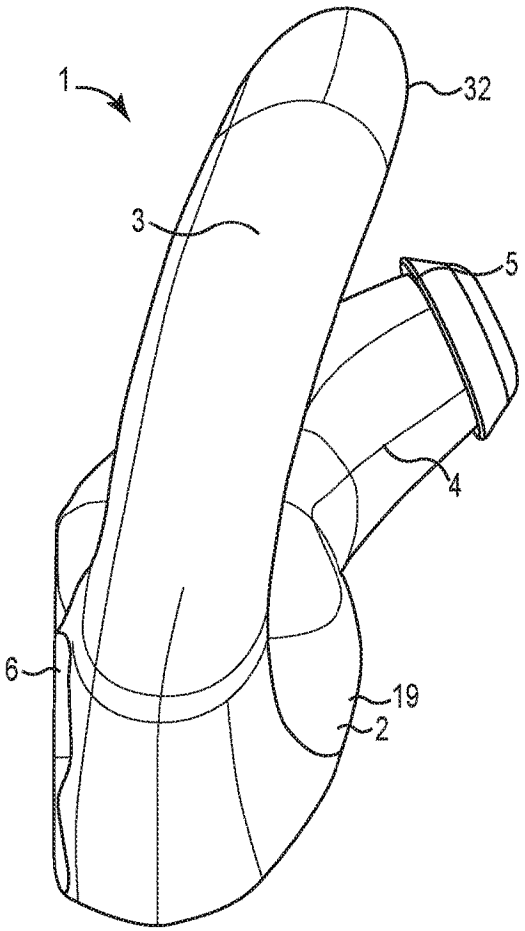
FIG. 3 is a back view of the first embodiment.
Figure 2:
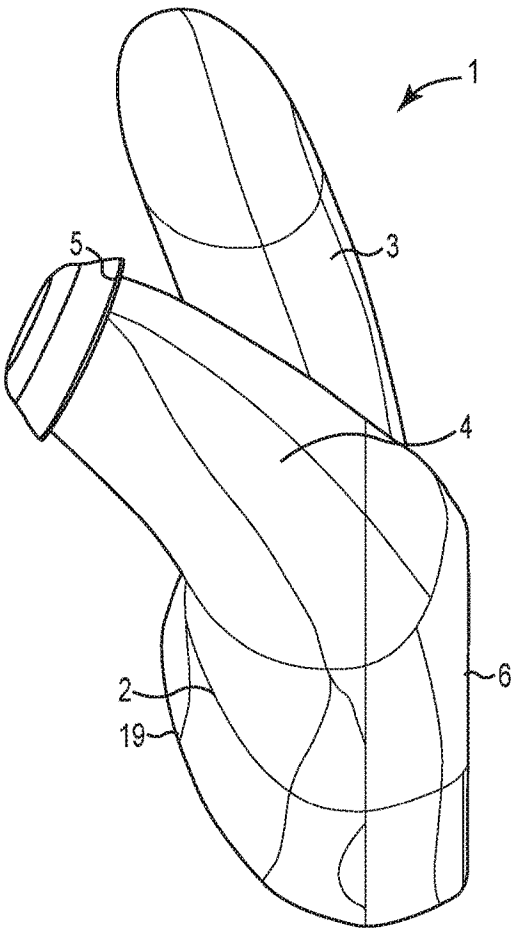
FIG. 2 is a front view of the first embodiment.
Figure 5:
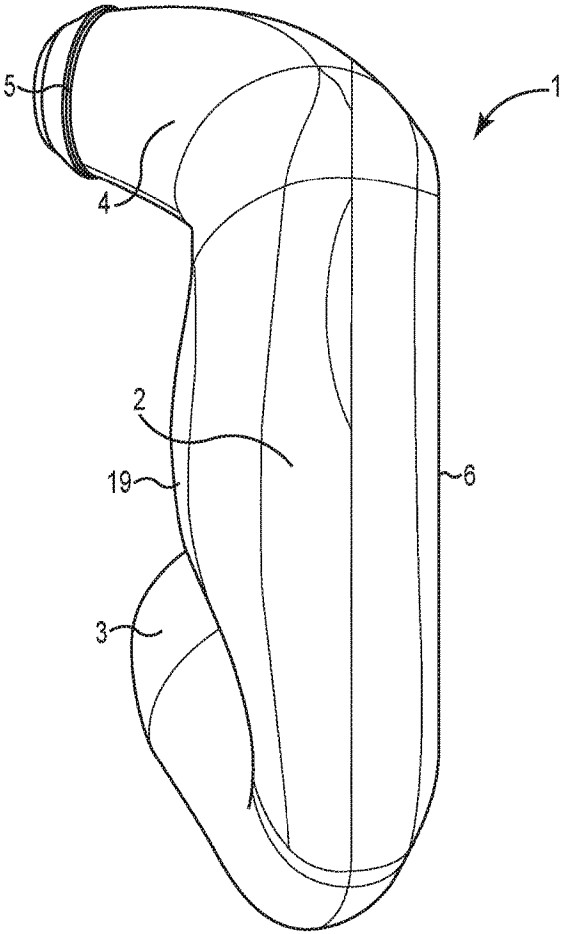
FIG. 5 is a bottom view of the first embodiment.
Figure 4:
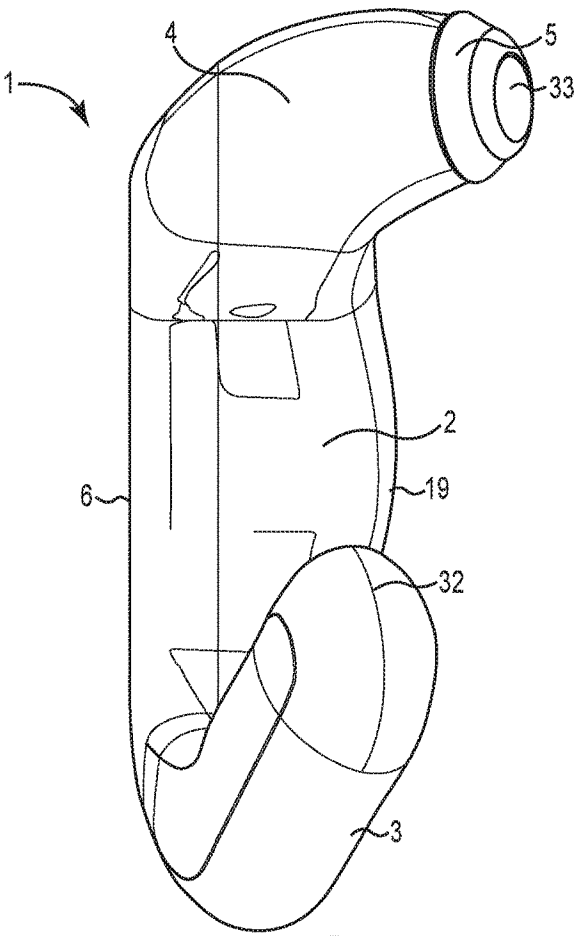
FIG. 4 is a top view of the first embodiment.
Figure 7:
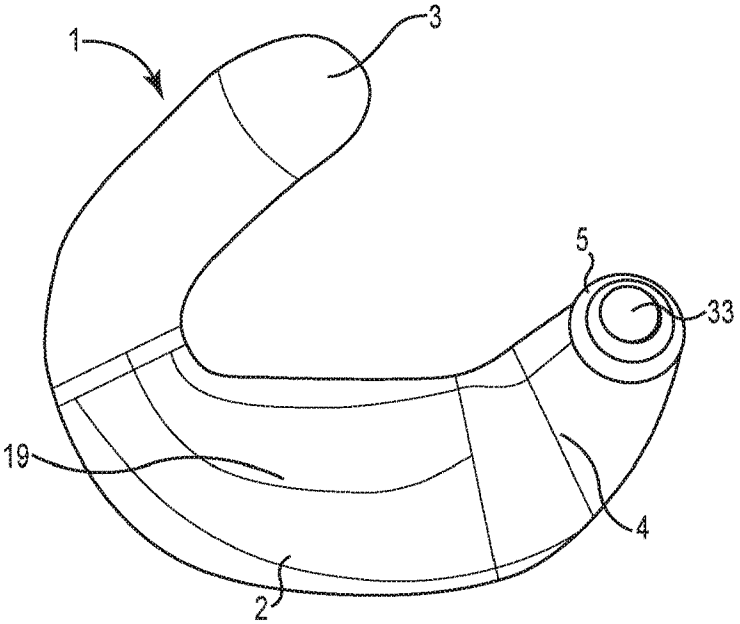
FIG. 7 is a left side view of the first embodiment.
Figure 6:
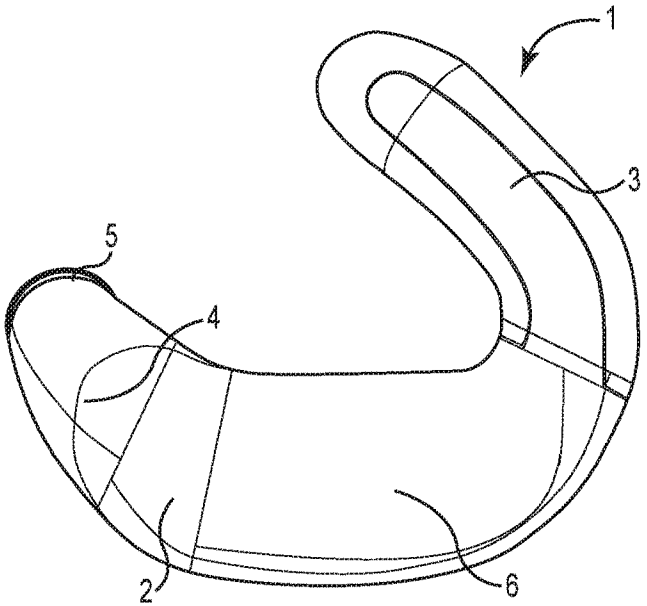
FIG. 6 is a right side view of the first embodiment.
Figure 14:
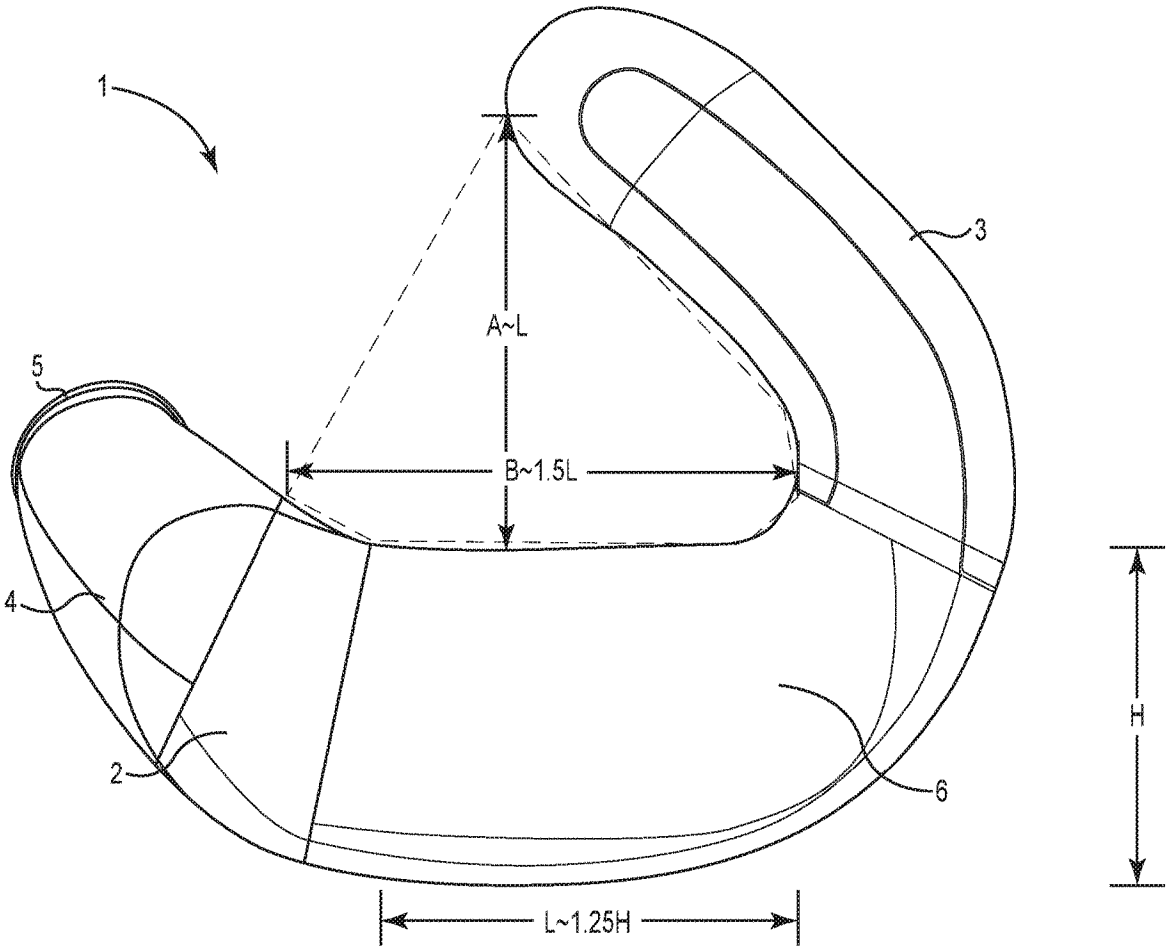

In general descriptive terms, base 2 is generally ellipsoidal, or barrel-like-shaped (not considering any shape of outer face 6, which is variable as discussed further below). It is longer than it is tall (see also FIG. 14, illustrating that both B and L are greater than H) although not substantially so. Base 2 has an inner face 19 which curves outwardly to contribute to the barrel-like shape. Base 2 is also curved along its lowest portion, as can be seen in FIGS. 2 and 3, although it is generally flat along its highest portion, as can be seen in FIGS. 6 and 7, before it slopes upward to smoothly join helix extension 3 and ear canal extension 4.

Figure 13:
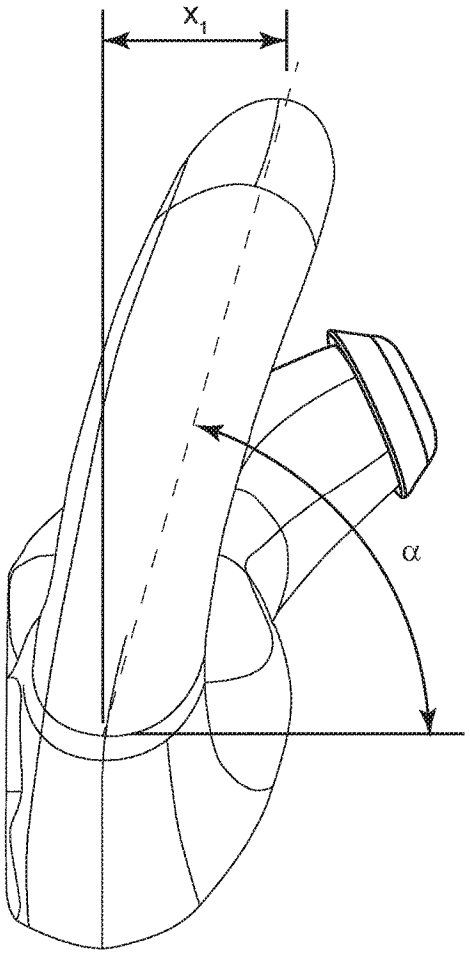
FIGS. 12-14 are respective front, back, and left side views of the first embodiment, illustrating certain features of each.
Figure 12:
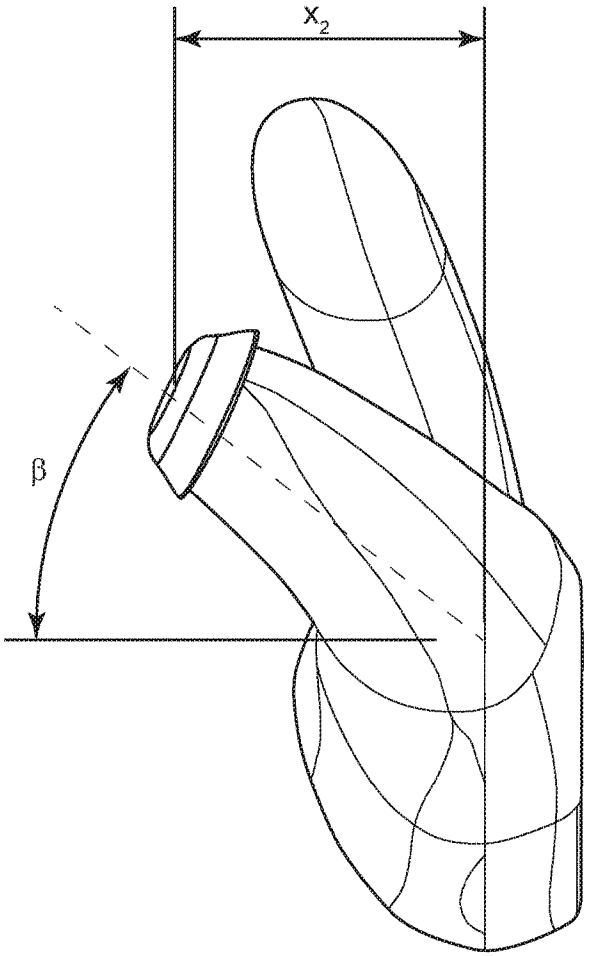

Helix extension 3 is narrower in thickness than base 2 in both directions transverse to its longest extension. Helix extension 3 smoothly but substantially curves away from the rearward end of base 2, curving back toward the forward direction in a near-U-shaped manner and also extending upwardly by a substantial amount relative to the dimensions of base 2. As best seen FIGS. 3 and 4, but also visible in other figures, helix extension 3 curves sharply upward but less so inwardly, and extends only enough that its distal end 32 lies approximately as far inward as the maximum extent in the same direction of inner face 19 of base 2 (note also the discussion below of offset distances A and B as shown in FIGS. 12 and 13). Similarly, it can be seen from FIGS. 6 and 7 that helix extension 3 curves and extends upwardly by a substantial amount, enough that its distal end lies well above the maximum height of base 2, above the height of all of ear canal extension 4, thus contributing to the substantial gap between the two at the mouth of open area 12 discussed below.

Ear canal extension 4 is generally shaped like a curved, tapered horn, having a larger diameter where it smoothly extends away from the forward end of base 2 than it does at its distal, forward end which extends into the external ear canal when worn. As best seen FIGS. 2 and 4, but also visible in other figures, ear canal extension 4 curves and extends enough that its distal end lies farther inward than the maximum extent in the same direction of inner face 19 of base 2, so much so that its distal end lies farther inward than the maximum extent in the same direction of helix extension 3 (note also the discussion below of offset distances A and B as shown in FIGS. 12 and 13). Similarly, it can be seen from FIGS. 6 and 7 that ear canal extension 4 curves and extends upwardly enough that its distal end lies above the maximum height of base 2, but not nearly so much as to approach the height of the lowest portion of the rounded end of helix extension 3, thus contributing to the substantial gap between the two at the mouth of open area 12 discussed below.

Optional feature 5 is provided at that distal (farthest into the ear canal) end of ear canal extension 4 so that, if desired, flexible and pliable ear buds of conventional open or closed design (not shown) may be provided. In commercial embodiments, such ear buds are preferred for comfort, aesthetics, and other reasons not critical to the scope of this application. Thus, optional feature 5 is illustrated by way of example only as a ring-like ridge or shoulder biased back toward base 2 but this approach is only preferred and not required.

Ear canal extension 4 often does, but need not, define an internal lumen or other open channel for passage of sound 33; passage 33 is not necessary if earpiece 1 is being used for hearing protection or other forms of passive noise suppression (in which case earpiece 1 may be constructed entirely of noise-suppressing foam or other conventional materials known for that purpose). In other cases, such as when active (typically electronic) noise masking, tinnitus protection or therapy (e.g., providing white or pink noise to mask the tinnitus), volume level limiting, or other form of suppression is provided, ear canal extension 4 will have an internal lumen or other open channel 33 for passage of sound to and from the ear canal. This will also be the case when earpiece 1 is used for hearing enhancement, such as for a personal sound amplification product (PSAP) or hearing aid of any type.

For purposes of this application, a hearing aid is any wearable instrument or device that is intended to compensate for impaired hearing; and a PSAP is a wearable electronic product that is not intended to compensate for impaired hearing, but rather is intended for non-hearing impaired consumers to amplify sounds in the environment for a number of reasons, such as for recreational activities. PSAPs are devices which allow users to amplify sound but are not programmable in the field, as distinguished from hearing aids which are programmable in the field to the wearer's specific hearing loss with the assistance of trained dispensers or audiologists (i.e., the PSAP amplification level is set at the time of manufacture and cannot be reset by the user). Examples of their use include hunting (listening for prey), bird watching, listening to lectures with a distant speaker, and listening to soft sounds that would be difficult for normal hearing individuals to hear (e.g., distant conversations, performances).

Earpiece 1 may also be used for isolation or privacy (e.g., as part of a set of wired or wireless earphones or other receivers mounted in the outer ear) and again ear canal extension 4 will define an internal lumen or other open channel for passage of sound to and from the ear canal.

It should therefore be understood that earpiece 1 is predominantly a mechanical platform primarily designed for fit into the outer ear, with the other functionality of a product containing earpiece 1 determined essentially entirely by the material of earpiece 1 (in cases such as noise suppression) and the electronic/acoustic components which are used with (or incorporated into) earpiece 1. Such electronic components and functions may be combined together in any manner as desired. For example, both wireless (e.g., Bluetooth™) communications and audio functions may be combined as known in the art.

Other types of functions which may be supported by earpiece 1 include medical monitoring (including, but not limited to, temperature, heart rate, and other parameters) known to be possible from within or in the vicinity of the ear canal, whether such monitoring is done by electronic devices or conventional acoustic devices (e.g., a pair of earpieces 1 could be the earpieces of a traditional acoustic stethoscope). Any such function can be incorporated using wired or wireless technology as required. Of course, such monitoring may be acute or chronic, and need not necessarily occur in a clinical setting (e.g., pulse rate monitoring combined with music listening is possible for long distance runners and other athletes).

Earpiece 1 could support traditional communications equipment in situations where comfort and/or discreteness are desirable, such as the personal communications equipment used by automobile drivers, motorcycle riders, football players (e.g., sidelines/helmet communication), automobile racing drivers (pit/helmet communication), pilots, television personalities, musicians, public safety (uniformed or undercover police, firefighters, paramedics, emergency medical technicians and other first responders, private security personnel), translators, etc. Yet another application is consumer audio. For example, the comfort provided by earpiece 1 over long periods of time suggests that one potential use is long term wear so that the user hears music which changes as their location changes, such as when walking from one room to another, or when speeding or slowing down during exercise, etc.

Figure 20:
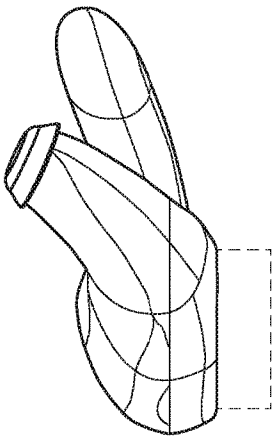
Figure 22:
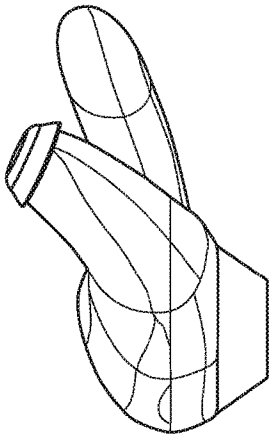

Thus, in commercial application, the outer face 6 of base 2 may vary in shape in various embodiments to accommodate any of a variety of electronic configurations (or mechanical features dictated by the same). It therefore is illustrated in FIGS. 1-6 as a relatively flat surface by way of example only. For example, turning briefly to FIGS. 10-11, it may be seen that outer face 6 may define features such as an opening 7 to a hollow interior 30 of base 2, or a socket 8 to accommodate electrical components and connections described further below. Turning briefly to FIGS. 20-23, it may be seen that the shape schematically indicated by the dashed lines in FIG. 20 is variable, and can include (by way of example and not limitation), a generally gently curved surface (FIG. 21), a truncated cone or frustum (FIG. 22), a semi-spherical surface (FIG. 23), and in general any surface extending transversely away from the ear.

Figure 8:
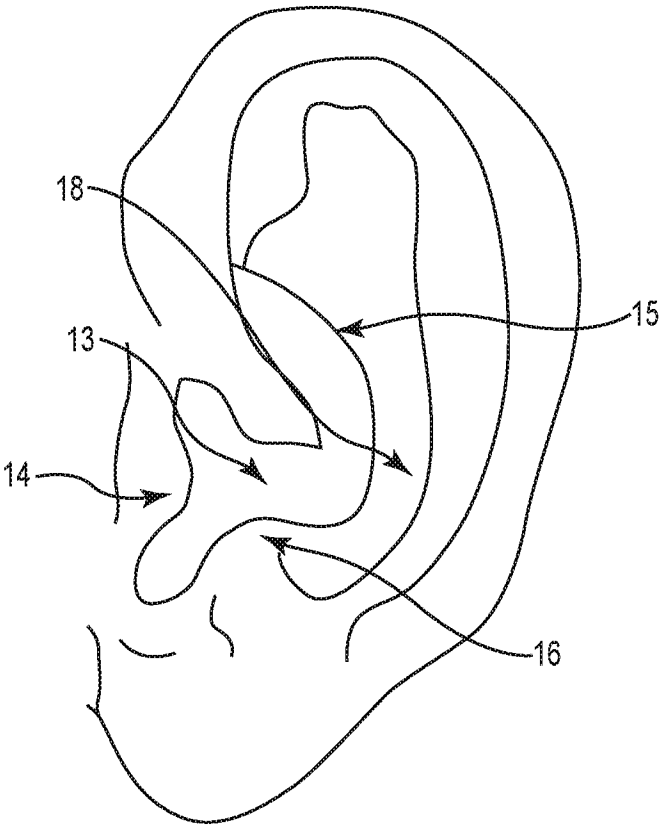
FIG. 8 is a schematic view of a left outer ear illustrating certain anatomical features.

Returning to FIGS. 1-7, by contrast to the outer face 6, inner face 19 of base 2 is curved toward the ear canal when viewed in both the longitudinal (front/back) and transverse (upper/lower) directions, giving base 2 a barrel-like shape in the vicinity of inner face 19. This allows earpiece 1 to conform to the concha bowl. Turning to FIG. 8, the human outer ear is pliable at the four contact points identified: the concha bowl 13, tragus 14, helix 15 and anti-tragus 16. The outer ear therefore has the ability to stretch at these four contact points, allowing the hearing device to move in response to the wearer talking or chewing. Because these four points of the earpiece or shell are in contact with the wearer's ear, a custom device is not needed and an earpiece having standard size and shape works quite well. The result is greater wearer comfort, approaching that of a custom earpiece, than would be provided by a standard-fit earpiece that contacts more surface area of the outer ear.

Figure 9:
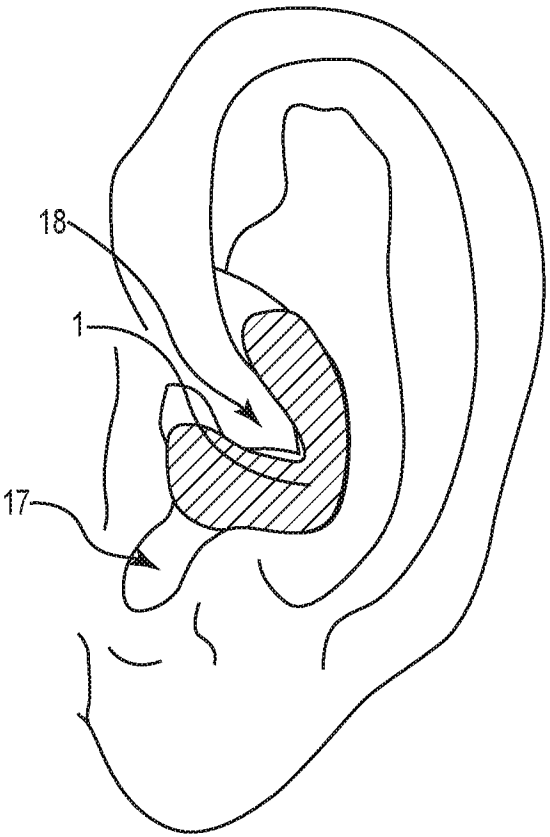
FIG. 9 is a schematic view similar to FIG. 8, illustrating the placement of one embodiment in the outer ear.

It is important to note, comparing FIGS. 8 and 9, that earpiece 1 does not contact the intertragal notch 17; and further that the earpiece 1 is extremely concave (as described further below) so that it can accommodate (i.e., does not substantially lie over) the crus of concha 18. Thus, earpiece 1 fits in the concha bowl but does not invade the ear canal and does not extend to the extremity of the ear lobe. It is also apparent from FIG. 9, which shows earpiece 1 in place, that helix extension 3 does not support a wire or other external connection to earpiece 1.

The earpiece may be manufactured from a wide range of materials, including hard incompressible acrylic (such as polymethyl methacrylate or "PMMA" known by the brand name "Lucite"); plastic (including thermoplastics such as acrylonitrile butadiene styrene or "ABS"), or metal; and soft materials such as silicone or polyethylene. Multiple colors may be incorporated into these materials to provide increased cosmetic appeal, especially for younger wearers.

The helix extension 3 can be made of different materials from the remainder of the earpiece, such as hard acrylic or flexible vinyl or silicon. The helix extension portion may be replaceable with tips having different length and shape. Earpiece 1 may be a single piece (neglecting, for this purpose, any contents of hollow interior 30 or any door or socket as described below), but a separate helix extension 3 may attach and detach to base 2 via a convenient mechanism such as a ball and socket assembly or other known features which mate together. It is also possible to form earpiece 1 (or any portion of it) from multiple pieces if desired.

Similarly, the ear canal extension 4 can be made of different materials from the remainder of the earpiece, such as hard acrylic or flexible vinyl or silicon. The ear canal extension portion may be replaceable with portions having different length and shape. A separate ear canal extension 4 may attach and detach to base 2 via a convenient mechanism such as a ball and socket assembly or other known features which mate together.

The earpiece may be manufactured such that a large portion of the ear canal is not occluded, providing a more natural sound quality by reducing the occlusion caused by unvented earpieces that result in wearers sometimes describing the sound quality of their own voices as "my head is in a barrel" or "my voice sounds hollow."

For purposes of retention of the earpiece in the outer ear, the ear canal is not one of the contact points for the earpiece by itself. The earpiece alone inherently leaves the ear canal unoccluded. Different size soft ear tips may be attached to the shell to provide a closed fitting by sealing the earpiece to the ear canal.

Figure 10:
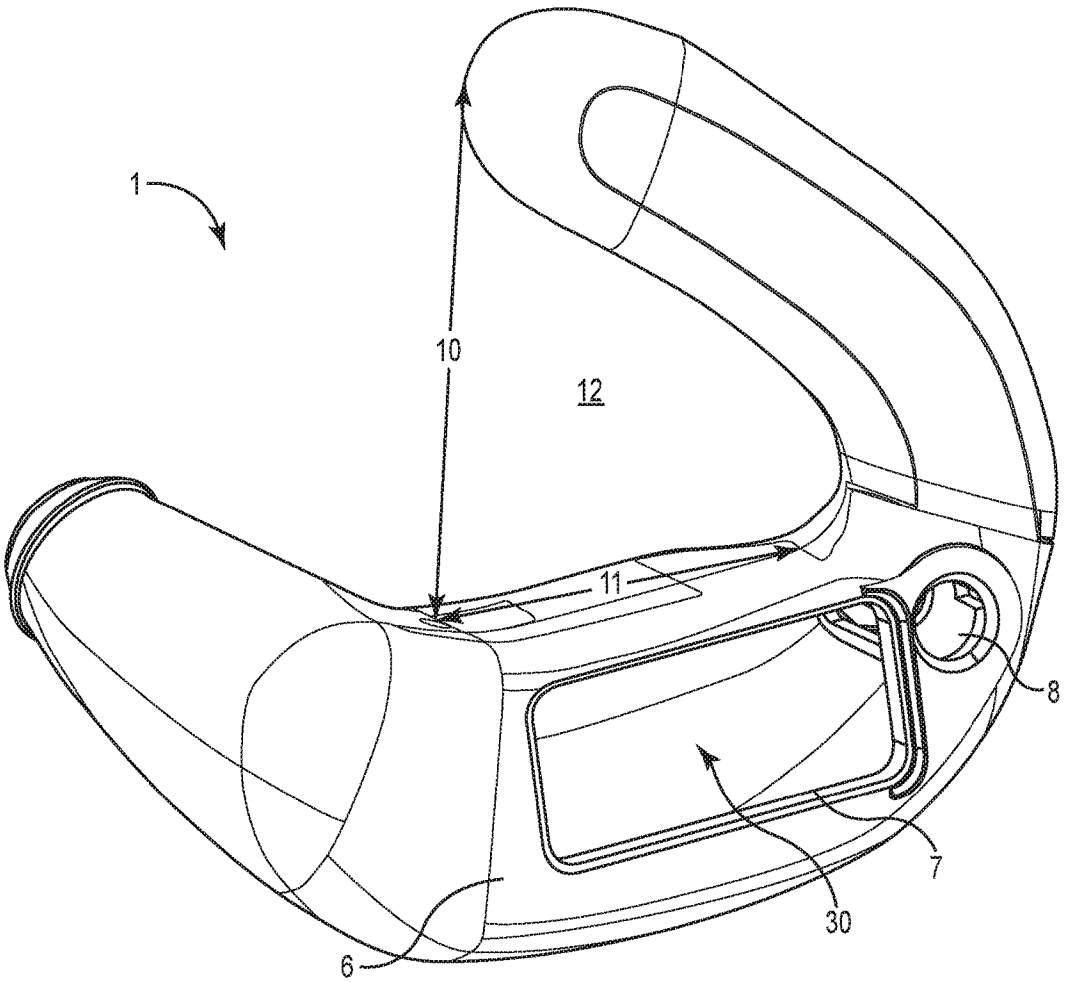
FIGS. 10 and 11 are perspective views of an alternative embodiment.
Figure 11:
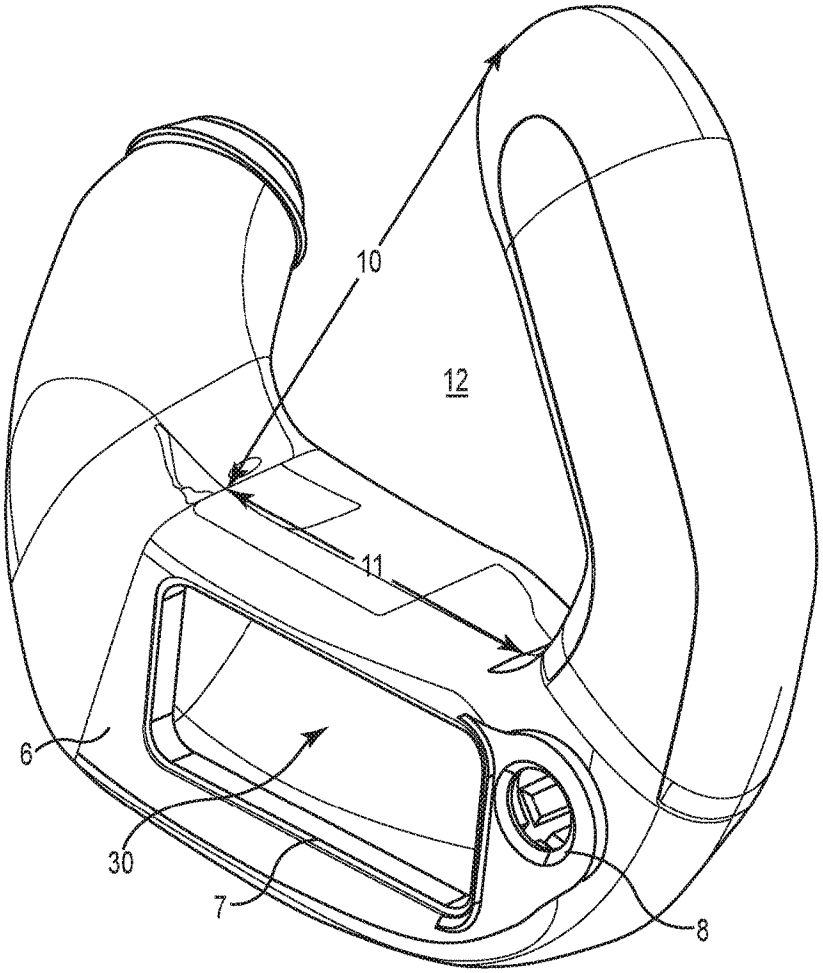

FIGS. 10-13 illustrate various dimensional aspects of the preferred embodiment. Notably, as shown in FIGS. 10-11, for a given length 11 of base 2 taken along the plane generally corresponding to the top of base 2, helix extension 3 rises above that plane and extends a substantial amount until it ends a significant distance above the top of base 2, thus creating a significantly large open area 12. Using the forward end of length 11 as a reference, distance 10 is the same order of magnitude as distance 11. In a preferred embodiment, distance 10 is approximately 12.2 mm and distance 11 is approximately 13.5 mm.

Turning to FIGS. 12 and 13, it can be seen that in general, distance 11 is on the order on one half of the entire height of earpiece 1, or in the same preferred embodiment, approximately one half of the overall height of approximately 26.1 mm. Yet the base 2 of earpiece 1 is quite compact: in the preferred embodiment it is approximately 10 mm high (measured to the same plane as length 11 is taken along, described above) and approximately the same thickness (depending somewhat on whether front face 6 is extended as described elsewhere); in the embodiment illustrated, the width is approximately 12.25 mm or the same order of magnitude as length 11.

FIGS. 12 and 13 also illustrate the notable angles made by the central axes of helix extension 3 (FIG. 13, angle $\alpha$) and ear canal extension 4 (FIG. 12, angle (3), resulting in offset distances $X_1$ and $X_2$, respectively. Such angles are determinable even if it is not the case that front face 6 is flat (as illustrated) because the plane of front face 6 generally corresponds to the vertical plane when earpiece 1 is positioned within a human ear.

In the case of ear canal extension 4, the axis of the extension as a whole is not necessarily the center line of any lumen 33 though which sound passes. It may be desirable to have such a lumen 33 define a turn or bend as opposed to being straight. For example, it may be necessary for a speaker or other transmitter to fit into a central cavity such that it is "pointed" toward the proximal end of the lumen which lies in a first direction within ear canal extension 4, while the distal portion of the lumen needs to be directed in a second direction within ear canal extension 4 so that it is "pointed" toward the center of the ear canal for maximum effectiveness. It is also not necessary for the lumen 33 to have a constant diameter, although it is possible.

Figure 19:
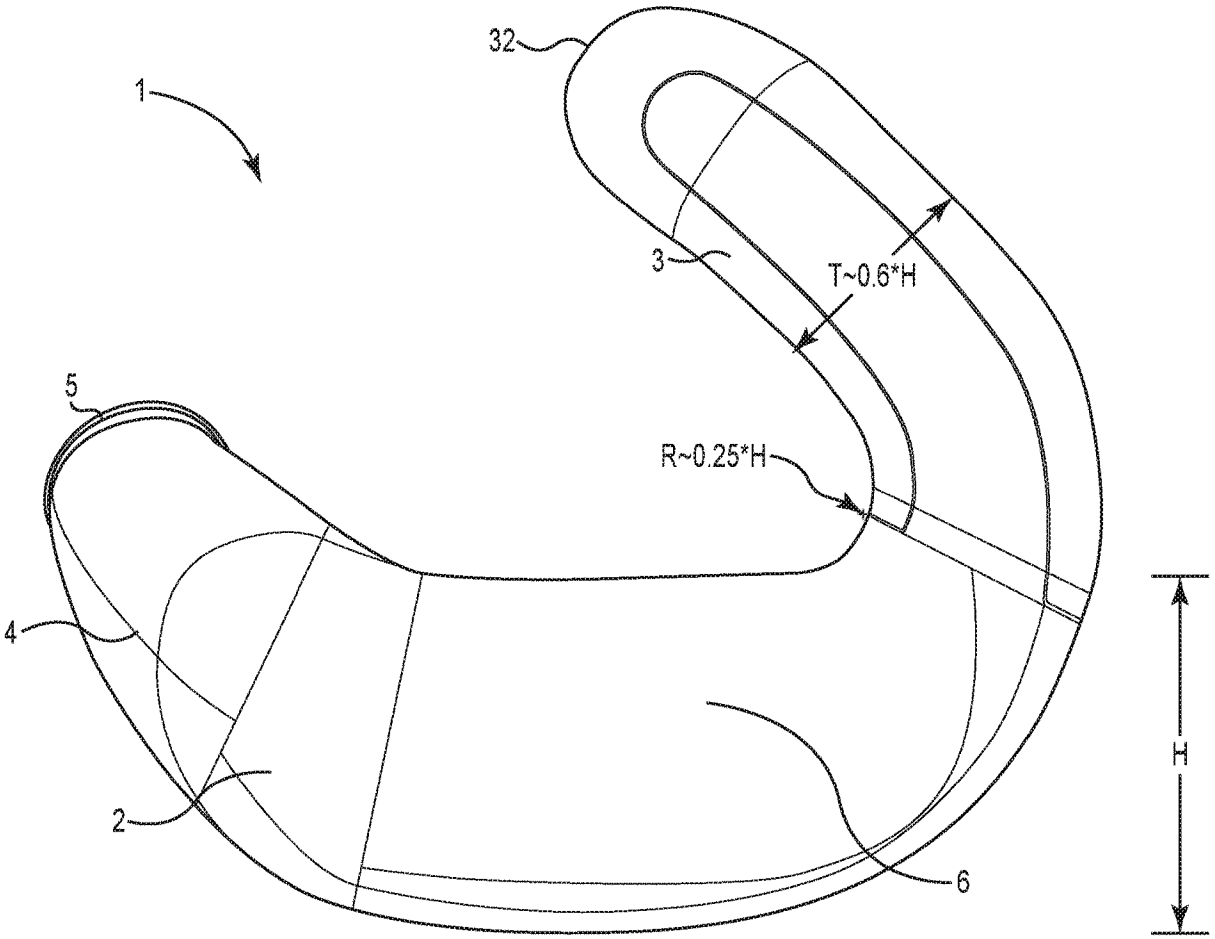
FIG. 19 is a left side view supplementing the illustration of FIG. 14.
Figure 21:
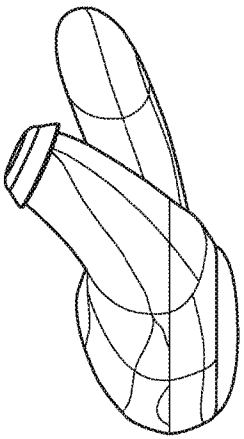
FIGS. 20-23 are front views schematically depicting a series of alternative embodiments.
Figure 23:
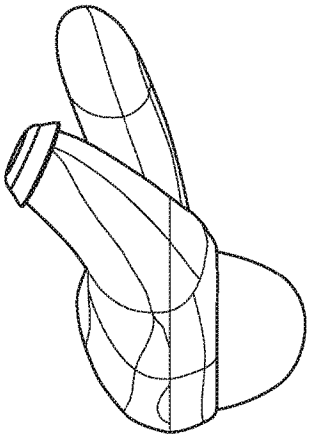

FIG. 14 illustrates one methodology for expressing the amount of open area 12 in terms of dimensions of base 2. As shown, the central portion of base 2 may be modeled as a rectangle of height H and length L~1.25*H, with the reference point for length L taken from the deepest location of area 12. An approximately triangular shape can be used to measure area 12, using a base B~1.5*L and height A~L, which yields the result that area 12 is approximately $0.94*H^2$. Thus, for H~10 mm, the area is approximately 94 $mm^2$. This substantial amount of open area 12 is due, in part, to the extreme depth to which open area 12 extends into the C-shaped opening defined by the base 2 and helix extension 3, as well as the relatively small thickness of helix extension 3. Another way to see this, turning briefly to FIG. 19, is to consider that the radius of curvature of the joint between base 2 and helix extension 3 (i.e., the deepest part of the C-shaped opening) extends a substantial amount around a circle having a radius of curvature on the order of only 0.2-0.25*H, yet helix extension 3 has a thickness T~0.6*H.

It should also be noted that open area 12 is not the "open area" as that term is used in U.S. Pat. No. 7,394,910, namely, an area completely surrounded by material or D-shaped (see especially Figure and column 6, lines 56-64). Such a closed-perimeter region cannot accomplish the objective of avoiding coverage of the crus of concha 18 (FIG. 9).

As noted before, as shown in FIG. 10, the outer face 6 may define either or both of an optional opening 7 or optional socket 8 providing access to internal components, if present. Depending on the nature of such components, opening 7 may be closed by a door or similar feature (not shown), such as a "battery door" commonly used in conventional hearing aids. Either opening 7 or socket 8 could be the location where a wire or similar conduit (e.g., an acoustical conduit such as the tube of a stethoscope) is connected to earpiece 1. The size and shape of opening 7 and socket 8 are arbitrary and dictated by the function of the components they accommodate. For example, a possible configuration for socket 8 is an industry standard connector such as that known as CS-44 (or CS-45), an example of the use of which is disclosed in U.S. Pat. No. 6,319,020. While socket 8 may be used for any purpose, a common use will be to support connection of remote programming equipment, or to perform functions needed only on occasion, such as uploading data to any electronics supported by the earpiece platform, or downloading data gathered by such electronics, depending on the nature of the electronics. Socket 8 (or another socket not shown) could be a Direct Audio Input (DAI), or any other direct connection to an external audio source like a DVD/CD player or an assistive listening device (ALD). Other possible uses for socket 8 include (without limitation) connections for BTE and wireless modules, battery or charging connections, connections between units in the left and right ears, microphones, eyeglasses (for hearing aids, 3D television, etc.), and any other suitable accessory.

FIGS. 15-18 are perspective schematic views of various alternative embodiments. Each embodiment uses a version of earmold 20 which has a sound channel within the ear canal extension so that sound may be presented to the ear from electronics mounted at least partially within the hollow interior 30 of the base; for purposes of illustration only, a door or other portion of the base lying generally on the outer face of the base is omitted and the electronics are shown schematically, i.e., the exact size and location of the electronic components may vary from those shown in the figures. (These figures also indicate a possible, but not required, joint 31 where a separate base and helix assembly may mate together, as described above.)

Such electronics include (depending on the alternative embodiment), a receiver (speaker) 21; one or more omnidirectional or directional microphone systems 22; a "behind the ear" (BTE) or other external module 23 which houses various electronic components and is shaped and sized according to conventional principles (e.g., eyeglasses); battery 24; digital signal processor (DSP) 25; and one or more external microphones 26, such as those that form components of a directional microphone system 22. The directional microphone systems 22 may be those commercially available from Sonion A/S (Roskilde, Denmark), Knowles Electronics, Inc. (Itasca, Ill., USA), and the like, including those used in commercially available products by companies such as Starkey Laboratories, Inc. (Eden Prairie, Minn., USA), Siemens Hearing Instruments, Inc. (Piscataway, N.J., USA and Erlangen, Germany), and others. Other components (e.g., antenna, auxiliary battery, mounts for components within the earmold 20, and so on) may be provided in a commercial application as understood in the art. Electrical and mechanical connections between such electronics and earmold 20 are not shown for clarity, and neither are electrical connections between or among components that would be understood to the person of ordinary skill in the art. For example, the BTE or other external module 23 may be electronically connected to earpiece 20 by a conventional wire [as illustrated] or a wireless signal which is not numbered. Such a wireless signal may be a Bluetooth™ connection, a near field magnetic induction signal, or a radio frequency (RF) signal of any conventional type.

Figure 15:
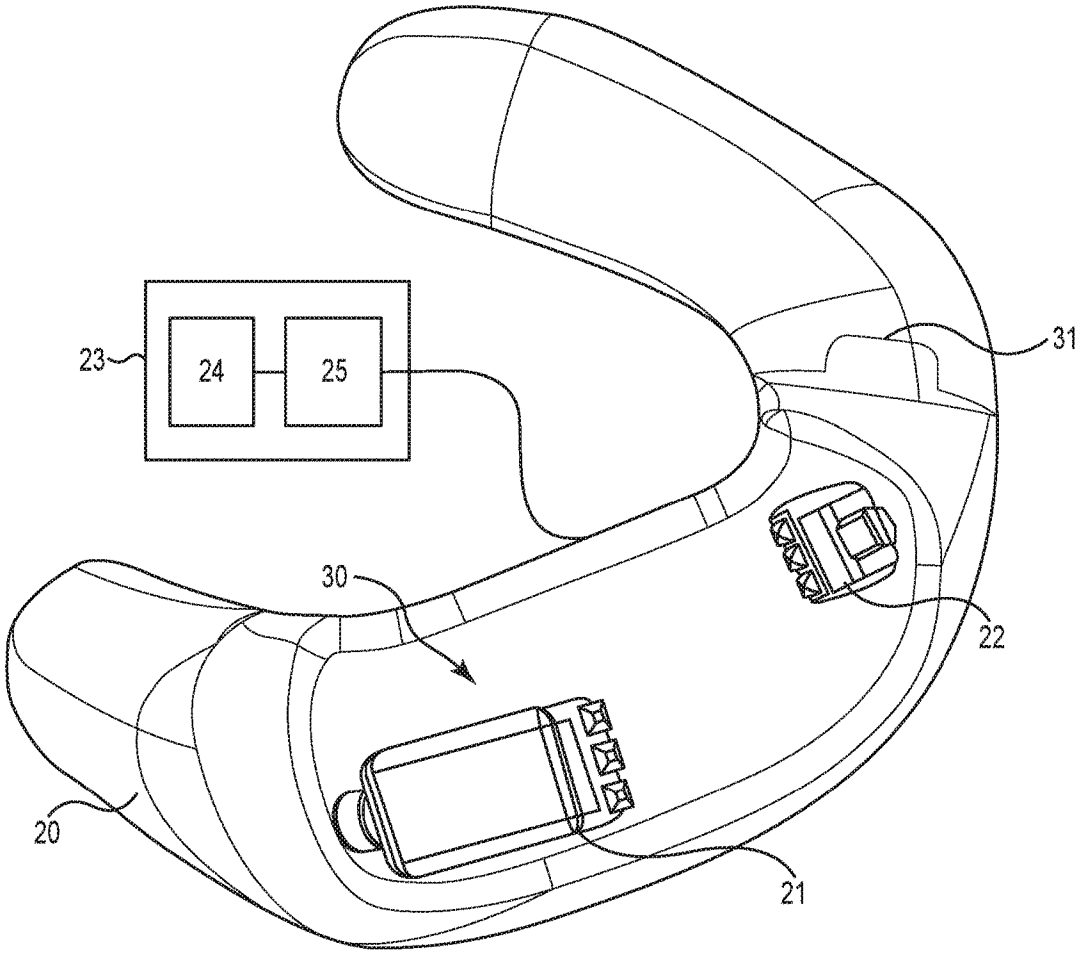
FIGS. 15-18 are perspective schematic views of various alternative embodiments.

In FIG. 15, the receiver 21 and omnidirectional microphone 22 (one illustrated) are mounted within the earmold 20 and connected to an external module 23 which houses a battery 24 and DSP 25. External module 23 could be Bluetooth™-enabled and/or housed in a BTE type of housing or shell (as that term is commonly understood in the art). This configuration of earmold 20 could be a replacement for the in-canal portion of the "MaRiC" architecture of hearing aids such as those known as "Ytango" and commercially available from ExSilent BV of Amsterdam, The Netherlands (or their functional equivalents), i.e., designs in which the microphone and receiver are in the outer ear canal. This and other features which may be combined with earmold 20 are described in one or more of United States Published Patent Applications US 2009/0316940, US 2009/0262964, US 2011/0299709, US 2011/0166680, and US 2011/0316727.

Figure 16:
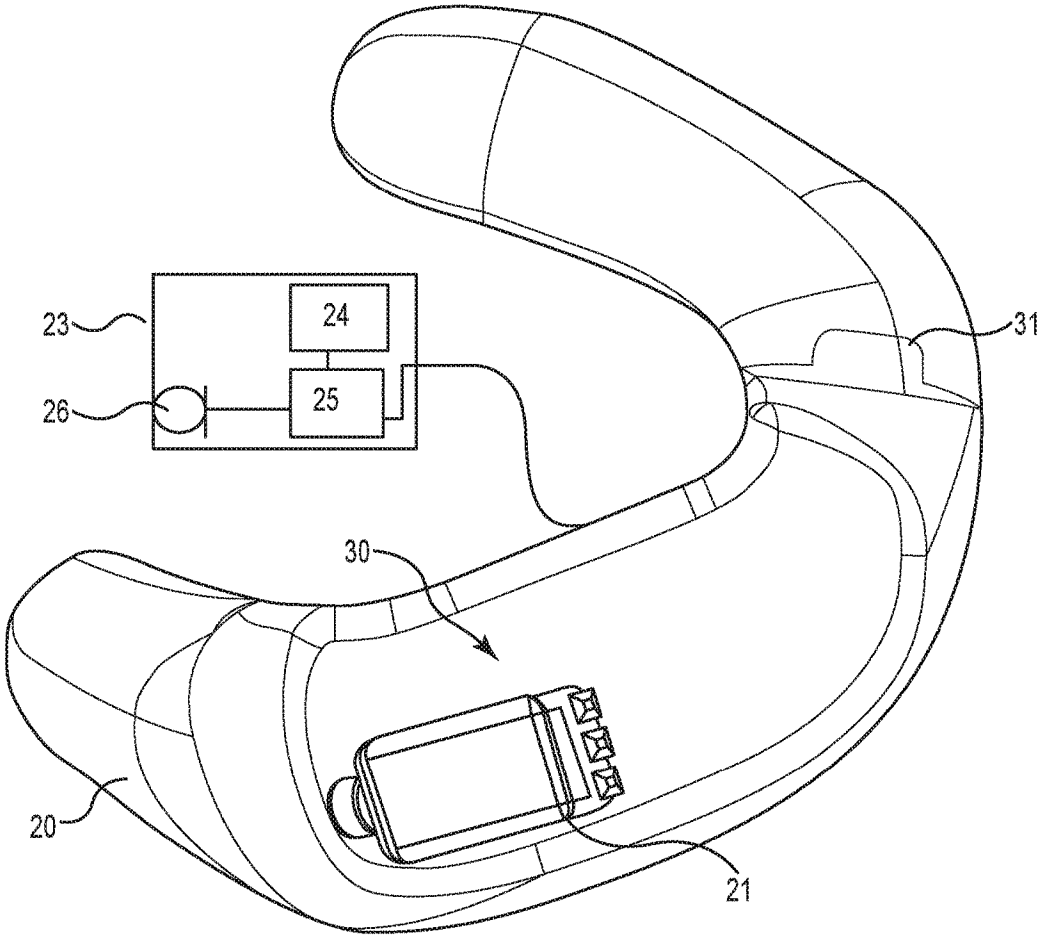

In FIG. 16, the receiver 21 is attached to an external module 23 that houses the battery 24, DSP 25, and (as illustrated) a single omnidirectional or directional microphone 26. This configuration is suitable for replacement of the in-ear portion of existing R-I-C (receiver-in-canal) hearing aids. One variation on this approach, not specifically illustrated, would use one or more microphone systems 26 in the external module 23 as described with respect to FIG. 18, below. Another variation, again not specifically illustrated, would use a wireless-connected microphone (omnidirectional or directional, as desired) incorporated into a neck loop communicating with the external module 23 and/or earmold 20, according to principles understood by those skilled in the art.

Figure 17:
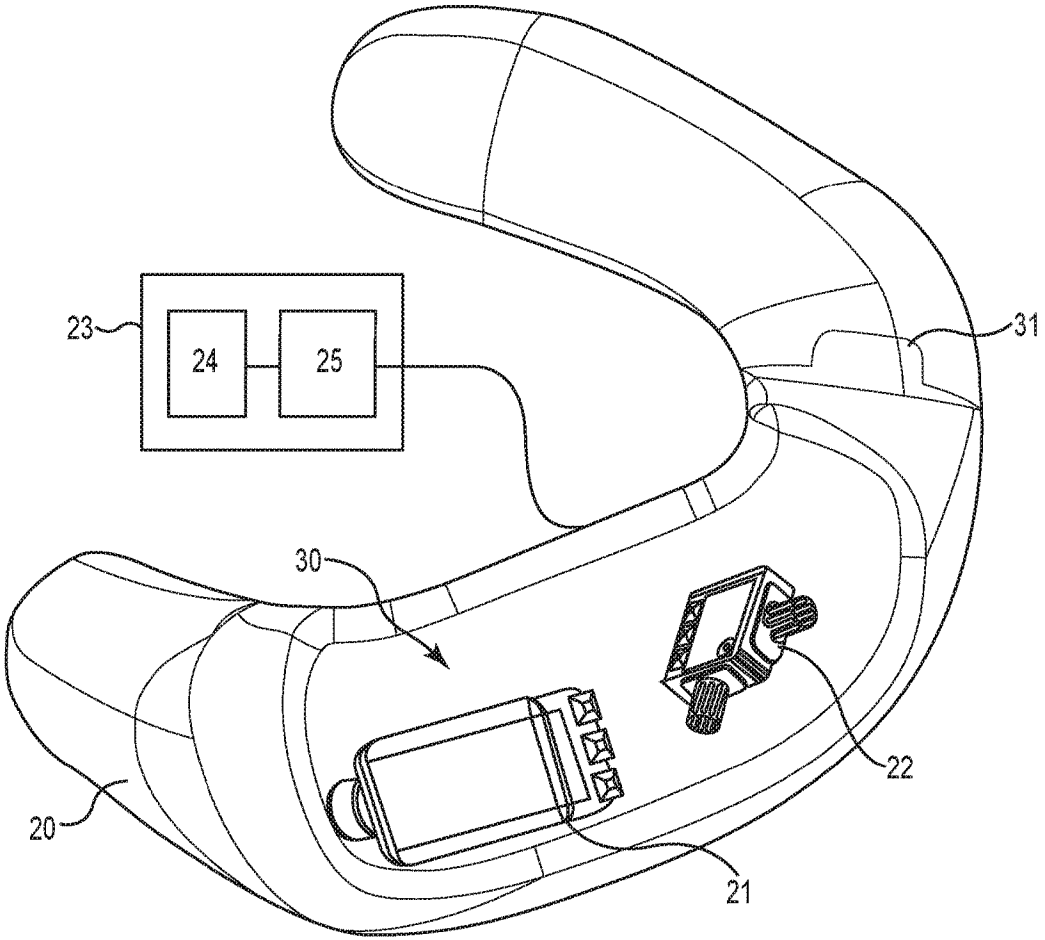

In FIG. 17, earmold 20 houses a receiver 21 and one or more directional microphone systems 22 (only one of which is shown for clarity). The external module 23 houses the battery 24 and digital signal processor 25. External module 23 could be a Bluetooth™ module housed in a BTE module or a directional microphone version of the "MaRiC" unit of hearing aids noted above with respect to FIG. 15.

Figure 18:
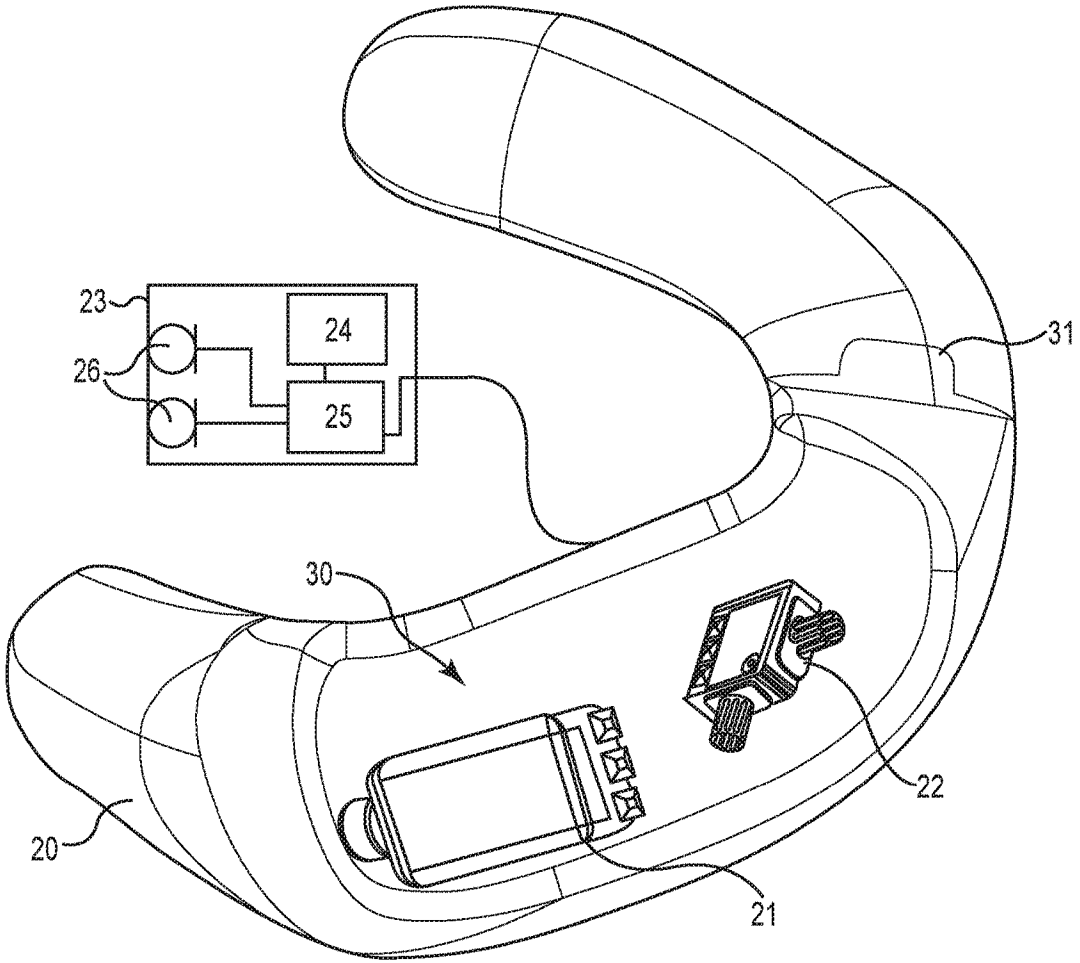

In FIG. 18, the external module 23 houses the battery 24, DSP 25, and at least one directional microphone system 26. In addition, the earmold 20 houses both the receiver 21 and one or more directional microphone systems 22 (only one of which is shown for clarity). This configuration is like that shown in FIGS. 15 and 17 but adds at least second order directionality possible from use of directional microphone systems. It is also possible to incorporate further increases in directionality by use of smaller components which allow for use of additional microphones and associated components. For example, there could be more than one directional microphone system 22, because two of them could be ganged with the directional microphone system 26 to create a higher order system.

In any embodiment of earpiece 1 (or earpiece 20), if a battery (such as battery 26) is used, it should be understood that such battery may be permanent, replaceable, or rechargeable; and if rechargeable that it may be recharged by directly connecting a power source (e.g., though a socket 8, or through a wired connection such as could be included with wires connecting the earpiece to an audio source using an audio induction loop ["Telephone Coils" or "telecoils" or "T-coils"] to filter out background noise), or by wireless recharging techniques known in the art (including, but not limited to, inductive charging with or without resonant inductive coupling [electrodynamic induction]). See, for example, US Patent Application Publication US 2011/0069854 A1. If wireless recharging is employed, a preferred location for any near field coils (NFCs) required is within helix extension 3.

Thus, the selection of what type of battery and/or recharging technique is employed dictates other non-critical design decisions, e.g., if the battery is not replaceable because it is wirelessly rechargeable, then a door in outer face 6 to access the battery is not required.

Example

A random sample of seventy-seven individuals in the United States were provided with an identically sized pair of (left, right) embodiments manufactured from inflexible and incompressible acrylic material and produced from the molds created with the solid model CAD file used to generate FIGS. 1-7. The sample included forty-three males and thirty-four females of varying ages greater than ten. Each individual was asked whether the embodiment fit comfortably in each ear. All subjects reported consistent bilateral results, i.e., either both ears fit comfortably, or both ears did not fit comfortably. Comfortable fit in both ears was reported by forty-two of forty-three males (fit rate 97.7%) and thirty-one of thirty-four females (fit rate 91.2%) for a blended fit rate of 94.8%. This is substantial improvement over the results reported in U.S. Pat. No. 4,878,560, which required "six different standard sizes [to] fit approximately 95% of normal ears." More importantly, these results were obtained with an inflexible material, in total contrast to the teaching of that patent that the fit rate of 95% "is made possible by the relative flexibility of the earmold. The flexibility also helps keep the ear mold in position during normal activities of the user." The preferred material in that patent had a durometer softness of 42 (A scale) and was composed of styrene-rubber copolymer, but the patent specifically teaches a requirement that "the plastic is . . . soft enough to be comfortable to the wearer." Thus, the embodiment tested here unexpectedly achieved equally high fit rate despite use of a single size and despite using the exact opposite type of materials as taught by U.S. Pat. No. 4,878,560.

Unless disclosed and claimed otherwise, the construction of any embodiment of the invention follows standard design criteria and parameters suitable for the intended purpose, including compliance with government or industry standards. It should also be understood that references in the drawings or their accompanying written description may refer to electrical "lines" or similar terms which are used to refer to not only the electrical wires, traces, or lines themselves, but also the associated connections, circuitry and the like that would be understood by the person of ordinary skill in the art of electronic design to be desirable, necessary, or included for any purpose, even if not specifically stated. For example, power supplies, ground connections, etc. that are not critical to the scope of the invention may be omitted from the drawings or description for purposes of clarity, even if such items would be employed in commercial embodiments of the invention. There are no limitations on the scope of the invention, except as described in the following claims. In particular, the following claims may use the language "first," "second," "third," and so on to specifically distinguish between various elements that are otherwise similarly named. These terms are not intended to imply any order of importance or time sequence in manufacturing or use, unless other claim language specifically does so.

We claim:

1. An earpiece for a hearing device or communication device for a wearer having an inner ear, an outer ear comprising a concha bowl, a crus of concha, and an intertragal notch, and an ear canal inwardly directed from the outer ear to the inner ear, the earpiece comprising:

a base having a forward end and a rearward end defining between themselves a length between the forward and rearward ends;

an ear canal extension of the base, inwardly directed from the forward end of the base, the ear canal extension smoothly extending away from the forward end of the base; and a helix extension of the base which substantially curves away from and above the rearward end of the base;

in which the base substantially fills the concha bowl but does not contact the intertragal notch and does not substantially lie over the crus of concha.

2. The earpiece of claim 1, in which the earpiece touches the outer ear in a minimum number of four contact points of the outer ear, the contact points being the helix, tragus, anti-tragus and concha bowl.

3. The earpiece of claim 1, in which the earpiece is made of a material selected from acrylic, plastic, ABS, metal, vinyl and silicone.

4. The earpiece of claim 1, in which the earpiece comprises at least one of a replaceable helix extension and a replaceable ear canal extension.

5. The earpiece of claim 4, in which at least one replaceable helix or ear canal extension attaches to the earpiece via a ball and socket assembly.

6. The earpiece of claim 4, in which at least one replaceable helix or ear canal extension is made of a different hardness material than another portion of the earpiece.

7. The earpiece of claim 1, further comprising a feature for attaching a soft eartip.

8. The earpiece of claim 1, in which the earpiece provides passive hearing protection.

9. The earpiece of claim 1, in which the base has a hollow interior.

10. A system comprising an earpiece according to claim 1, in which the base has a hollow interior, and the ear canal extension of the base defines a sound channel within the ear canal extension; the system further comprising electronics mounted at least partially within the hollow interior of the base of the earpiece, in which the electronics comprises a receiver within the hollow interior of the base, an external module electronically connected to the earpiece having a battery and a digital signal processor within the external module, and at least one microphone connected to at least one of the electronics and the external module.

11. The system of claim 10, in which there is a single microphone mounted at one of within the earpiece and within the external module.

12. The system of claim 10, in which the external module is one of Bluetooth™-enabled, RF-enabled, and near-field-inductive enabled.

13. The system of claim 10, in which there are one or more directional microphone systems each mounted within one of the earpiece and the external module.

14. The system of claim 10, in which the external module is electronically connected to the earpiece by one of a Bluetooth connection, a near field magnetic induction signal, or a radio frequency signal.

15. The system of claim 10, in which the external module is a behind-the-ear module.

16. The system of claim 10, in which the system monitors a medical parameter from within or in the vicinity of the ear canal.

* * * * *